United States Patent [19]

Talarico, II

[11] Patent Number: 4,642,911

[45] Date of Patent: Feb. 17, 1987

[54] DUAL-COMPRESSION FOREFOOT COMPENSATED FOOTWEAR

[76] Inventor: Louis C. Talarico, II, 116 Wood St., P.O. Box 180, Lewiston, Me. 04240

[21] Appl. No.: 706,582

[22] Filed: Feb. 28, 1985

[51] Int. Cl.[4] ..... A43B 13/12

[52] U.S. Cl. ..... 36/30 R; 128/583

[58] Field of Search ..... 36/28, 30 R, 31, 32 R, 36/44; 128/581, 582, 583, 584

[56] References Cited

U.S. PATENT DOCUMENTS

| | | | |
|---|---|---|---|
| 2,616,190 | 11/1952 | Darby | 128/583 |
| 4,364,189 | 12/1982 | Bates | 36/31 |
| 4,547,979 | 10/1985 | Harada et al. | 36/30 R |

FOREIGN PATENT DOCUMENTS

| | | | |
|---|---|---|---|
| 981902 | 1/1976 | Canada | 128/584 |
| 660551 | 5/1938 | Fed. Rep. of Germany | 128/581 |
| 1284967 | 8/1972 | United Kingdom | 128/584 |

OTHER PUBLICATIONS

The Master Shoe Rebuilder, vol. X, No. 10, Oct. 1950; vol. XIII, No. 1, Jan. 1953.

*Primary Examiner*—Henry S. Jaudon
*Assistant Examiner*—T. Graveline
*Attorney, Agent, or Firm*—Caesar, Rivise, Bernstein, Cohen & Pokotilow, Ltd.

[57] ABSTRACT

An article of footwear is provided. The article includes a sole which has forefoot and rearfoot portions. The sole forefoot portion has both a medial and a lateral aspect. The sole forefoot portion is comprised of different compressibilities of materials selected and arranged across the width thereof such that the sole effectively slopes at an angle upwardly from the lateral aspect to the medial aspect when weight-bearing forces are exerted on the forefoot and thereby providing an effective inclined surface of resultant thickness greater at the medial aspect of the forefoot than at the lateral aspect as a result of less compressible material at the medial aspect of the forefoot than at the lateral aspect when the sole of said article of footwear is intended for use by individuals whose feet have a tendency toward compensation in a pronated direction due to their inherent inverted forefoot varus foot type.

Conversely, whereby the sole forefoot portion is comprised of different compressibilities of materials selected and arranged across the width thereof such that the sole effectively slopes at an angle upwardly from the medial aspect to the lateral aspect when weight-bearing forces are exerted on the forefoot and thereby providing an effective inclined surface of resultant thickness greater at the lateral aspect of the forefoot than at the medial aspect as a result of less compressible material at the lateral aspect of the forefoot than at the medial aspect when the sole of said article of footwear is intended for use by individuals whose feet have a tendency toward compensation in a supinated direction due to their inherent everted forefoot valgus foot type.

17 Claims, 15 Drawing Figures

DUAL-COMPRESSION FOREFOOT COMPENSATED FOOTWEAR

BACKGROUND OF THE INVENTION

The present invention relates to any type and to all styles of new footwear that effectively alters the relative angulation of the forefoot portion of an article of footwear to its rearfoot portion; thereby compensating the natural human foot to modern society's usually flat surface environment. The present invention is intended for any and all footwear wherein dual-density or dual-compressibility materials or combinations of different materials may be incorporated into either the midsole, outersole, or innersole construction of the footwear in order to accommodate the forefoot in its natural position. As used herein, "dual-density" shall be understood particularly to mean "dual-compressibility".

The forefoot compensations of the present invention are designed to accommodate the majority of foot types by compensating for the inherent planal predominances of the forefoot from society's usually flat surfaces In this way abnormal and excessive amounts of pronation or supination of the foot are reduced, controlled, or eliminated along with all of the attenuating structural symptomotology of the feet, legs, and back that are so commonly seen in clinical medical practice.

Embryologically, the feet and lower limbs undergo a highly specialized sequence and series of rotations and torsions during their development in order to become effective weight-bearing and propulsive structures. The ontogenic process of lower limb rotation and torsion begins in the seven to eight week old embryo At twelve weeks of fetal growth, the foot begins to rotate and by sixteen weeks the foot, (which previously had been held in an inverted attitude in its classical in utero position), begins to evert. For most individuals, at our present state of phylogenic development, these maneuvers fall slightly short of what would otherwise be considered full, complete, and ideal rotation of the lower limbs and feet. Consequently, the infant (and adult) foot is still left slightly inverted somewhat, so that the lower legs and plantar surface of the feet are not redirected sufficiently to be positioned on flat standing, walking, or running surfaces without having to compensate additionally and in some way in order to effectively meet and come in contact with society's flat surfaces.

Rarely, and perhaps only by chance, a pair of feet will undergo a more extensive and "complete" process of rotation so that this individual will have a foot type that is "ideally" suited, perfectly square and level, for functioning on society's flat surfaces. This ideal foot type and phenomenon is only recognized, however, in less than 1% of the world's population.

Occasionally, the embryonic and fetal foot will undergo an excessive amount of rotation whereby the forefoot section of the foot goes beyond the point where the plantar surface of the forefoot would be parallel to the plantar surface of the rearfoot. Again, this forefoot type would also not be ideally suited for function on a flat surface without causing the foot to supinate excessively. This forefoot valgus foot type occurs in less than 5% of the population.

Differences in the amounts of rotation of the lower limbs and feet are ultimately very closely related to the extent and severity of all structural foot pathology. And yet, almost all individuals have an amount of forefoot rotation that is not conducive for their feet to function on consistently hard, flat, and unyielding modern surfaces.

From an evolutionary perspective, man's problem is further understood when one considers that, at the time that the human foot first adapted itself for bipedal terrestial standing and locomotion; the ground was often uneven, soft, and yielding. The entire plantar surface of the foot, regardless of its structure, was often able to come into full contact with the supporting ground surface, at least some of the time, without having to compensate excessively and constantly.

In this regard, man's technological environment has evolved more rapidly than the architecture of his foot; while the human foot is still almost identical to the foot of our ancient ancestors. Structural and functional adaptive changes of an organism, organ, or body part come about very slowly and enormous intervals of time are necessary for a species to evidence any change. Since embryology recapitulates phylogeny, it does not appear that major evolutionary changes of the human foot are in the immediate offering; nor does it appear that flat surfaces (floors, pavement, sidewalks, etc.) will be constructed differently in the near future. Therefore, certain functional design features incorporated into articles of footwear that will provide a more suitable interface between the natural positions of the foot and society's flat surfaces, such as those described by the present invention, appear to offer the best solution.

In order to correctly understand the anatomical positions in open and closed chain kinetics of the human foot, certain terminology is necessary which accurately describes the foot in a number of different ways. It is imperative that the foot be viewed and understood both in its natural, off weight-bearing (open chain kinetics) positions relative to the surface upon which it is intended to function; and also, in its accommodated positions once the foot has assumed partial and full weight-bearing body forces (closed chain kinetics) in its compensated positions on the surface upon which it bears.

Additionally, it is also important that the human foot be described during each of the various phases of its gait cycle during the act of human locomotion and on the basis of a part-to-part spacial relationship assessment that describes positions and movements of one part of the foot to another and each of these parts of the foot to the floor at specific moments during its function. In this regard, the forefoot (metatarsus) section of the foot needs to be considered independently from the rearfoot (tarsus) section of the foot in both static and dynamic situations. Only when the foot is thus viewed, first segmentally, does it become possible to note that the structure and stability of the rearfoot and forefoot sections of the foot are, in fact, intricately dependent upon each other when the position, motion, and function of the foot is considered as a whole.

Foot function must also be described according to the relative position and motion of the forefoot, the rearfoot, and the lower leg; each one to the other and each to the surface (ground or floor) upon which the foot bears.

The prevailing and predominent foot type at the present state of our phylogenic and anatomic development is naturally angulated somewhat from the horizontal plane, upward from its lateral side. For most individuals, the feet and lower legs are held slightly inverted or tilted, off weight-bearing, so that the plantar surface of the foot faces slightly toward the midline of the body and away from the transverse plane. In this regard, the foot and lower leg, off weight-bearing, are usually still in a slightly varus attitude, generally bent inward, not unlike their position in the classical in utero fetal position. This tendency toward a slightly inverted angulation of most feet and lower legs is, in fact, residual and inherent from their fetal growth as previously mentioned.

In most individuals the heel and rearfoot portion of the foot is almost always slightly inverted relative to the transverse (horizontal) plane by approximately 4 degrees plus or minus amounts up to 2 degrees on the average. This position of the rearfoot, off weight-bearing, has commonly been referred to as rearfoot or subtalar joint varus and had been considered to be a deviation from the "normal" foot type according to the prior art. This position of the rearfoot, off weight-bearing, is actually quite normal and is considered by the applicant to be the most usual and most frequently occuring position of the rearfoot, off weight-bearing. Rearfoot or subtalar joint varus should, in fact, be considered the normal rearfoot type as a result of its widespread prevalence and our ability to clinically observe and measure this clinical entity in the greatest proportion of the general population.

The forefoot or metatarsus portion of the foot is also most often found to be inverted additionally to the rearfoot by an added amount of approximately 8 degrees plus or minus amounts up to 6 degrees, on the average. This has been commonly referred to as forefoot or midtarsal joint varus and, again, had been considered to be an abnormal alignment and deviation of the forefoot portion of the foot relative to the rearfoot portion of the foot according to prior art standards. Only occasionally is the plantar aspect of the forefoot alignment found to be parallel and level to the transverse (horizontal) plane. In these occasional instances, the forefoot is considered to be ideally suited to adapt to/and function on modern society's flat surfaces.

It is also the applicant's opinion that a forefoot varus attitude of the forefoot relative to the rearfoot and relative to flat surfaces is, in fact, the most naturally and most frequently occuring attitude and position of the forefoot found in the greatest percentage (approximately 95%) of the general population. As a result of this finding, the relative structure and stability of the rearfoot (including instability and excessive over-pronation) is found to be much more dependent upon the structure and stability of the forefoot than had been previously considered according to the prior art. This statement is further supported by the fact that all attempts to date by shoe manufacturers to control excessive rearfoot pronation have been in the form of rearfoot control measures and functional design concepts directed solely at the heel and rearfoot portion of footwear rather than at the forefoot portion.

The lower legs are also usually inverted slightly to the ground by approximately 4 degrees plus or minus amounts up to 2 degrees, on the average. This position of the legs relative to the ground has been referred to as tibial or genu varum; however, this also is the most common attitude and position of the lower legs relative to the ground,contrary to the biomechanical criteria for normalcy of the prior art. Only occasionally are the legs anatomically straight and in perfect alignment, perpendicular to flat surfaces. In these rare and occasional instances, the legs are considered to be ideally suited for adaptation and functioning on modern society's usually flat surfaces.

Occasionally, both the rearfoot and forefoot sections of the foot are deviated from their usual, customary, and generally inverted alignment. While the prevailing human foot is usually angulated somewhat upward from the horizontal from its lateral side, there exists in a smaller percentage of the general population, a clinical entity whereby the forefoot section of the foot is everted, or rotated so that the plantar surface of the forefoot faces slightly away from the midline of the body and away from a transverse plane. In this regard, although the rearfoot and lower leg are still in their usual and slightly varus attitude, generally bent inward; the forefoot section of the foot is rotated and angulated in an opposite, valgus, direction relative to the rearfoot, the leg, and relative to a horizontal, transverse plane. This forefoot deviation is commonly referred to as forefoot or midtarsal joint valgus and is only recognized in approximately 5% of the population as a whole.

Only very rarely is the heel (rearfoot) alignment found to be perfectly perpendicular or square to the transverse (horizontal) plane. In these occasional instances, the heel (rearfoot) would be considered ideally suited to adapt to/and function on modern society's flat surfaces. On other extremely rare occasions, the heel (rearfoot) is everted or tilted and rolled outward while off weight-bearing so that the plantar surface of the heel faces away from the midline of the body and away from the transverse (horizontal) plane in its natural, relaxed, and dangling, position. This clinical entity is referred to as rearfoot or subtalar joint valgus and is only observed in individuals who exhibit true and frank foot deformity as differentiated from the more common deviations of foot type.

On other extremely rare occasions, the extent and degree of malalignment in the relative relationships of the forefoot to the rearfoot, the rearfoot to the leg, and the leg to the ground are of such severity and magnitude that they constitute quite serious and frank deformity of the foot (feet) or leg(s). It is not the purpose or intention of this invention to attempt to address these or other frank deformities of the feet or lower extremities. It is the express purpose and intent of the present invention to provide forefoot compensations for the more common, less obvious, forefoot varus and forefoot valgus variations of foot types by intervening in situations where otherwise, normal, healthy feet (including those with minor deviations in conformation and shape) are required to compensate in order to come in full and complete contact with modern society's flat surfaces when standing or completing a step in the act of human locomotion.

In the past, these otherwise usual and common "deviations" of foot and leg types were considered to be "abnormal". The reason for this error resides in the fact that the science of biomechanics and prior art footwear design and construction utilized society's horizontal, flat, and level surfaces as the basis for "normalcy" to which all feet were compared and to which all feet were required to conform. As a result of this thinking, any foot type that deviated in any way from society's usually flat surfaces was considered to be "abnormal"; in spite of the fact that the greatest numbers of individuals in our society present foot and leg types which are inherently inverted (and thus, "deviated") from the usual, (although not necessarily "normal"), flat surfaces in some way.

The term and expression, "bio-mechanics" itself had a further tendency to compound the original error and shoemaking tradition whereby most of the prior art shoes are constructed "flat for flat surfaces". In an attempt to combine the knowledge and information of the "bio"-science of living structures, with the knowledge and information of the "mechanical"-physical and mechanical laws of nature; it would appear that the early scientist may have had to compromise one of these sciences in order to effectively combine these two fields of study. Unfortunately, the principles and theories that presently govern the science of biomechanics developed as a result of an inaccurate appreciation and consideration of the human body. In the case of foot function, the human body was actually compromised in favor of modern society's usually and customarily flat surfaces being considered the standard to which the human body and, in particular, the feet and lower extremities were then to be compared.

It would also appear that the early biomechanists and biophysicists were lead further astray when they attempted to discuss the multifaceted motion of the major joints of the foot, ankle, knee, and hip rather generally in terms of the three cardinal body planes rather than attempting to describe these joints in the purely three dimensional environment in which we live. The human body, in its dynamic state, is capable of motion in, on. and/or between any and all of the cardinal body planes rather than having its position, motion, and function restricted to the three cardinal planes, i.e. the horizontal, transverse, and the sagittal planes themselves. Although most scientists recognize this fact; nevertheless, the horizontal plane was clearly established as the common denominator and the "normal plane".

It is important to note that the major developments in the field and science of biomechanics took place during the height of the Industrial Revolution. As a result, the early scientists took for granted modern society's usually flat, horizontal, unyielding surfaces (floors, sidewalks, pavement, etc.) and used flat surfaces as the basis to which all feet would be compared at the time when the criteria for "normal" position, motion, and function of the human foot were established. Consequently, what the early scientists considered to be the "normal foot type" was, in fact, a "perfect foot type"; that is, one that would lend itself most ideally to function on society's usually flat surfaces. Any variations or deviation from these criteria of the"biophysically ideal foot type" that did not meet the earlier criteria for "normalcy" were then considered to be "abnormalities" or deviations from the "normal (perfect)" foot type. The fact, however, remains that very few human feet are ideally suited to be positioned to function on modern flat surfaces without modification of the surface.

According to the prior art that governed the science of biomechanics, the "normal" foot was considered to "represent a set of circumstances whereby the foot would function in a manner which would not create adverse physical response in the individual". This definition was also applied to occasions when "the lower extremity is used in an average manner and in an average environment, as dictated by the needs of society at the moment". By adhering to these definitions of "normalcy" and by allowing the square and level principles from the mechanical world to prevail, rather than allowing the criteria for normalcy to be established on the basis of the most usual and most frequently occuring foot type; a false standard and false criteria for defining normal position, motion, and function of the human foot was established.

In addition, the "needs of modern society" cannot be considered particularly reasonable at the present time as evidenced by the unusual and pathological demands and physical responses that are elicited as a result of the still-contoured and generally inverted foot's attempt to constantly conform and compensate to society's usually flat surfaces.

The prior art biophysical criteria for "normalcy" were considered to be the "ideal physical relationship of osseous segments of the foot and lower leg for the production of maximum efficiency during static stance and locomotion". According to the prior art, the distal one-third of the lower leg was expected to be vertical; the ankle and subtalar joint were expected to lie in transverse planes parallel to the supporting surface; the bisection of the posterior surface of the calcaneus was expected to be vertical; the plantar aspect of the forefoot plane was expected to parallel the plantar rearfoot plane and both were expected to parallel the supporting surface. In this position the sagittal bisection of the posterior surface of the calcaneus was expected to be perpendicular to the plantar plane of the foot; and the plantar surface of the heads of the five metatarsal bones were expected to lie in a common plane parallel to the supporting surface. Such ideal relationships are seldom seen clinically. The prior art biophysical criteria for normalcy were based on the false assumption and premise that flat surfaces were the normal surface to which the body, and in particular, the feet and legs, were to be compared from a functional and mechanical standpoint. Accordingly, the use of the words "normal" and "abnormal" are inappropriate and inaccurate throughout all of the prior art literature and texts related to the science of biomechanics, the field of podiatric medicine, and the footwear design and construction industries.

According to the medical discoveries related to the present invention, prior art use of the word "normal" should more appropriately have been termed "ideal" when, in fact, the prior art authors were referring to the "ideal foot type" for use on flat surfaces. The word "normal" suggests to this author and is defined according to Webster's Unabridged Dictionary as "the average and established standard; that which occurs naturally; the usual condition, degree; mean; or average development".

The medical discoveries and research related to the present invention represent a quantum leap and paradigm shift in the thinking, beliefs, principles, theories, and terminology of the prior art fields and science of biomechanics. As a result of new criteria for considering "normal and abnormal" foot types, it is important that modern society's flat surfaces be recognized and condemned as the common pathological denominator.

While different positions and functions of the rearfoot are noted, both on and off weight-bearing, no discussion of actual rearfoot function in standing, walking or running is necessary for the purpose of this specification; since it is the sole intention of this specification and the present invention to provide footwear compensating the forefoot portion of the footwear only.

As previously mentioned, all prior art concepts in shoe design and construction, particularly in running shoes, have attempted to control excessive rearfoot pronation (and to a lesser extent rearfoot supination) by attempting to control only the rearfoot (heel) portion of the shoe. The many rearfoot control methods are too numerous to cite in this document; however, a review of the advertisements in any of the major running shoe magazines over the past decade will clearly show evidence of these prior art considerations and attempts to achieve better rearfoot control. Examples of these include: the Brooks Varus Wedge, the Etonic Allegro concept, the Etonic Dynamic Reaction Plate, Converse Stabilizer Bars, Asics Tiger Stabilizing Pillar, the Nike Cobra Pad, Puma's Tri-Wedge System, Reebok's Pronation Stabilization System, Symmetrical Flaring, Impact Sectors, Stability Sectors, etc.

The original and most notable of these rearfoot functional design features was the Brooks Varus Wedge TM detailed in Dr. Subotnick's U.S. Pat. No. 4,180,924. The prior art concerned itself only with changing the angular relationship between the heel and a flat surface. Subotnick in his U.S. Pat. No. 4,180,924 attempted to improve footwear by providing a running shoe with a wedge at the heel portion of the footwear. The wedge tended to compensate the heel to react to a flat surface in its attempt to avoid some excessive pronation. The emphasis seems to have been placed on compensating the heel since the heel in walking or running usually makes the first contact with the ground and is the area where excessive pronation or supination is most obviously noticed in most individuals.

Since the Brooks Varus Wedge TM concept, there have been many other attempts to stabilize and control the rearfoot portion of the footwear by attacking the rearfoot portion of the footwear itself. Block in his U.S. Pat. No. 4,262,435 also discloses a compensated heel. Both Subotnick and Block substantially ignore compensating footwear at the forefoot and its relationship to excessive pronation or supination.

Although each of these various functional design concepts may have provided some degree of rearfoot stability through their attempt to control excessive pronation at the rearfoot; none of these features consider the structure and stability of the forefoot and its relationship to the relative position, motion, and stability (or relative instability) of the rearfoot.

Most recent advertising for the Sako Super running shoe and the Pro-Specs Axis Plus running shoe do depict a dual-density compensation of the forefoot sections of their shoes. These compensations also extend the entire length of the footwear, however, from the tip of the toe to the back of the heel and thereby, once again, attempt to affect a degree of control on the rearfoot as well as on the forefoot sections of the shoe. This extended rearfoot compensation alters and adversely affects the natural function of the rearfoot and inhibits the rearfoot's natural shock absorptive quality and capacity. The present invention is for forefoot compensations only and in order for forefoot compensations to be most effective it is imperative that they be independent of any rearfoot compensations. In conversations with representatives from each of the above mentioned manufacturers (namely, Pro-Specs International and California Footwear, Inc./Sako) it is believed that the applicant's date of conceptualizing the ideas for forefoot compensations clearly precedes those of either of these companies and that no applications for U.S. Patent rights have been or are intended to be filed by either of these companies.

Excessive pronation and excessive supination are considered to be the unnatural positions, motions, and functions that the foot assumes when the foot is required to go through an excessive amount and range of motion in order to compensate for inherent anatomical variations or other planal predominances of the foot from flat surfaces. These compensations occur as a result of the body's attempt to adjust one part, (in these instances the forefoot), to a deviation of structure of another part, (in these circumstances horizontal flat surfaces).

Most weight-bearing feet must pronate abnormally and excessively on a flat surface in order for the medial aspect of the forefoot to reach the supporting surface and in order for the foot to compensate for its inherent inverted forefoot varus angulation. An inverted forefoot varus foot type, off weight-bearing, will usually end up in an excessively over-pronated position once it has been required to compromise its natural attitude when compensating to meet a flat surface in its fully weight-bearing position.

A foot is said to be pronated when the foot or any part of the foot is abducted, everted and dorsiflexed. The excessive pronation of the weight-bearing foot on a flat surface comes about when the normal foot, which off weight-bearing is slightly inverted, attempts to come down to meet and align itself with the ground supporting surface. In order to accomplish proper support, balance, equilibrium and ultimately propulsion, the rearfoot is required to follow the motion and action of the forefoot down to meet the ground from the inverted position and thus the entire foot pronates excessively. More specifically, the rearfoot goes through an excessive range of motion to allow this function and motion of the forefoot to occur due to the fact that rearfoot stability (or instability) is highly dependent upon the structure and stability (or instability) of the forefoot. The weight-bearing vector forces of excessive pronation are generated more medially and away from the longitudinal axis of motion and the midline of the foot and are directed more toward the midline of the body.

Those occasional foot types that are characterized and classified according to their everted forefoot valgus component, off weight-bearing, will usually supinate abnormally and excessively when they come into full and complete contact with flat surfaces in order for the lateral aspect of the forefoot to reach the supporting surface.

A foot is said to be supinated when the foot or any part of the foot is adducted, inverted and plantarflexed. Excessive supination of the weight-bearing foot on a flat surface comes about when, occasionally, some feet, which have a forefoot valgus component off weight-bearing, attempt to meet and align themselves with the ground (flat surfaces). In order to accomplish proper support, balance, equilibrium and ultimately propulsion, the rearfoot is required to follow the motion and action of the everted, (valgus), forefoot when the forefoot meets the ground and thus the entire foot (including the rearfoot) is forced to supinate excessively. More specifically, the rearfoot goes through an excessive range of motion to allow this function and motion of the forefoot to occur, once again, due to the fact that rearfoot stability (or instability) is very much dependent upon the structure and stability (or instability) of the forefoot. The weight-bearing vector forces of excessive supination are generated more laterally and away from the longitudinal axis of motion and the midline of the foot and are directed more toward the outside of the body.

A smooth, more ideal, movement of the foot, with a minimum of pronation and supination occurs when weight-bearing forces directed through the foot pass closer to the longitudinal axis of motion and the median sagittal plane of the foot as the foot moves through the various stages of its gait.

A small amount of rearfoot and forefoot pronation and supination themselves are considered to be normal and are necessary for the foot to act as an effective shock absorber and as a rigid propulsive lever during the act of locomotion. Beyond those accepted amounts, rearfoot and forefoot supination and pronation are considered to be abnormal, excessive, and not within an acceptable range of motion.

Since nearly all individuals within the general population possess different degrees of variation of foot type and amounts of abnormal pronation and supination, ranging from slightly excessive to extremely excessive; it is the purpose and intention of the present invention to compensate for as much of these varying amounts of pronation and supination that are in excess of the normal amount of allowable foot motion by prohibiting those additional and excessive amounts to occur. Excessive amounts of pronation and supination usually fall within the range of from 2 degrees to 14 degrees of additional motion; that is, motion which is in excess of the allowable amount of normal motion (normal pronation and normal supination).

Ideally, the weight-bearing foot should be in its natural planal predominent off weight-bearing position at the time when it makes full contact with the surface upon which the foot bears and when it is fully weight-bearing; rather than compensating to meet the flat surface. The present invention is for footwear which allows the forefoot to function in its predominently inverted or occasionally everted attitude and position with the footwear adapted to the environmentally flat surface; while the foot is comfortably positioned in its natural position.

It is recognized that a wide variety of soling materials are used in the fabrication of midsoles, outersoles, and innersoles in the shoe construction industries. These materials include: ethyl vinyl acetate (EVA) and polyurethane materials commonly found in the midsole units of running shoes; rubber, crepe, leather, vinyl, and plastic compounds commonly used in the manufacture of outersole units; and a variety of other materials including fabric, cardboard, cork, and wood products used in fabricating innersole units and components.

As a result of the significant technological developments of the last decade in the shoe construction industries; it will not be practical to discuss each of the various materials, compositions of materials, or the methods in which each are employed relative to the present invention. Some of these developments include: the use of synthetic materials; injection molding; pre-molded unit bottoms; and other highly specialized and sophisticated technologies. Additionally, when discussing soling materials it is important to recognize that varying thicknesses, densities, specific gravities, degrees of firmness, flexibility, compressibility, compression set, tear strength, and other factors are often noted within the same families of like materials. Other variables such as differences in the body weights of individuals wearing the same footwear, varying activities and uses of the same footwear, and other circumstances will also effect the physical properties of different, similar, or the same materials.

Generally, thicknesses of soling materials used in the shoe construction industries are graded in measurements of "iron units" with 48 irons thickness material being equivalent to one inch (1") or 25.4 millimeters of thickness. Densities and firmness (hardness and softness) of the soling materials which affect the material's compressibility, flexibility, and compression set vary according to the chemical composition, cellular structure, specific gravity, coarseness, and other factors intrinsic to the chemical compounding of the individual soling materials. The densities of soling materials are commonly measured in the shoe construction industries by use of a durometer which reports the relative hardness or softness of a certain material in terms of "durometer hardness units". Quite often, a five durometer plus or minus (5±) range of variation and tolerance in density will be noted in one area of a piece of soling material compared to that measurement noted in yet another area within the same piece of soling material due to uneven mixture, chemical compounding, curing, and other factors.

Although the present invention is uniquely concerned with different densities of materials employed to affect a functional change in the forefoot portion of footwear, and particularly, with the combining of at least two or more different densities of materials; the specific selection, arrangement, and placement of these combinations of materials is of primary importance to the present invention and to this specification. Other materials having resiliences similar to those materials previously mentioned may also be utilized as suitable substitutes in this invention.

In the past, materials of differing densities have been incorporated into footwear and are referred to as dual-density midsoles or outersoles. For example, the Knapp Two-Shot TM sole uses a soft Solite or Aerocrepe material as a midsole which is then laminated onto the top of a hard rubber outersole material. Although this sole provides a combining of different density materials, there is, however, no alteration of the weight-bearing forces directed through the forefoot portion of the footwear since both materials used in a Knapp Two-Shot TM sole are of the same uniform thickness and are located in exactly the same areas of the entire forefoot (and rearfoot, for that matter) portions of the footwear.

The recent advertisements for the Pro-Specs Axis Plus and Sako Super running shoes provide design concepts and configurations that are similar to at least two of the specifications noted in this patent application. These two shoes incorporate medial and lateral half dual-density forefoot varus and forefoot valgus specifications, respectively. No knowledge of the other two functional design specifications, namely, the 45 degree split dual-density forefoot varus and valgus compensations, as also noted in this patent application, have been noted at this time.

It has been found that on the average a difference of 15 to 25 durometers of hardness in materials is required in order to effect a 4 degree to 8 degree angular compensation and change in the forefoot portion of an article of footwear, either in a varus or a valgus direction. Quite often, the very width of the area comprising the entire forefoot portion of the footwear is not of sufficient breadth to achieve the preferred embodiment when utilizing dual-density materials by themselves. Materials of hardnesses greater than 50 durometers are often unsuitable for use as soling materials for certain types of footwear in which flexibility is a major requirement, i.e. running shoes, casual shoes, slippers, and the like. Heavy work boots, utility and safety shoes, etc. are exceptions whereby firmer soling materials are desirable. Consequently, in order to achieve the preferred embodiments of the forefoot compensations of the present invention; it is often necessary and advisable to laminate varying thicknesses of materials and varying densities of materials in order to achieve smaller or larger amounts of forefoot angular compensation.

It is a general object of the present invention to select dual-density materials that effectively compensate the forefoot by 8 degrees plus or minus amounts up to 6 degrees. Materials of 35 durometer hardness units plus or minus amounts up to 20 durometers are usually employed in order to provide good results at either the medial or lateral aspects of the footwear. Using materials of hardnesses that range from 15 durometers to 55 durometers will often provide an angular range and a set of parameters from not less than 2 degrees to not more than 14 degrees of effective forefoot varus or forefoot valgus compensation. As previously noted, however, in order to achieve higher effective angles of forefoot compensation; it is often necessary to combine dual-density materials with different and varying dimensions of materials. Tear strength of the materials selected and employed must also be taken into consideration since certain physical properties inherent to certain materials will often further predicate or preclude the selection of the various materials. This fact is of particular importance as it relates to the wearability of outersole materials.

When applying a 45 degree split dual-density forefoot varus compensation, the area of the denser accommodative material effectively slopes upward toward the medial aspect of the footwear in all directions from its vertex at the area beneath the lateral aspect of the fifth metatarsal-phalangeal joint. It then radiates from proximally to distally from this vertex and at a 45 degree angle to encompass the following areas of the forefoot: (1) the area beneath the base of the fifth metatarsal bone; (2) the area diagonal to the longitudinal and transverse arches of the foot and shafts of the metatarsal bones; (3) the areas beneath the five metatarsal-phalangeal joints (the ball of the foot) and; (4) the area beneath all of the toes. When applying a 45 degree split dual-density forefoot valgus compensation the area of the denser accommodative material effectively slopes upward and toward the lateral aspect of the footwear in all directions from its vertex at the area beneath the medial aspect of the navicular bone. It then radiates from proximally to distally from this vertex and at a 45 degree angle to encompass the following areas of the forefoot: (1) the area beneath the internal (medial) cuneiform and base of the first metatarsal bones; (2) the area diagonal to the longitudinal and transverse arches of the foot and shafts of the metatarsal bones; (3) the areas beneath the five metatarsalphalangeal joints (the ball of the foot) and; (4) the area beneath all of the toes.

When medial and lateral half dual-density forefoot compensations and methods are employed, the same area of the forefoot portion of the sole of the article of footwear is compensated; however, the forefoot is divided along its longitudinal axis into equal left and right halves. In the case of a medial and lateral half dual-density forefoot varus compensation, the material employed on the medial half of the forefoot is denser than the material used on the lateral half of the forefoot. In a medial and lateral half dual-density forefoot valgus compensation, the material employed on the lateral half of the forefoot is denser than the material used on the medial half of the forefoot.

For example, a sole of a shoe of a particular size, width, and style may incorporate a midsole material that is $\frac{3}{8}$ of an inch in thickness overall. Fifty plus or minus five (50±5) durometer, 18 iron ($\frac{3}{8}''$), EVA material is utilized on the lateral aspect of one-half of the forefoot section, while thirty plus or minus five (30±5) durometer, 18 iron ($\frac{3}{8}''$), EVA material is utilized on the medial aspect of the remaining half of the forefoot section. This method of compensating the forefoot portion of footwear constitutes the medial and lateral half dual-density forefoot valgus method. The opposite of this example would constitute the medial and lateral half dual-density forefoot varus compensating method. Often, a slight bevel is created at the area where the different materials are joined for better adherence of the two materials at their seam. The manner in which the different materials are joined is not, however, critical to the present invention unless the juncture of the different materials effectively alters the compensation and angulation of the forefoot.

In a manner similar to the above examples, fifty plus or minus five (50±5) durometer, 18 iron ($\frac{3}{8}''$), EVA material can be utilized and beveled at a 45 degree angle from the medial aspect across the entire forefoot section of the midsole to the lateral aspect. Thirty plus or minus five (30±5) durometer, 18 iron ($\frac{3}{8}''$), EVA material also beveled at a 45 degree angle is then laminated to the fifty plus or minus five (50±5) durometer EVA material in an opposite direction from the lateral to the medial aspects of the entire forefoot section of the midsole of the footwear. The overall dimension of this laminated midsole material would still be 18 iron or $\frac{3}{8}$ of an inch; however, a forefoot valgus compensation would have effectively been achieved by laminating these two different density (dual-density) materials. This method is referred to as a 45 degree split dual-density forefoot valgus compensation. In an opposite fashion, similar materials can be arranged in such a manner as to create a 45 degree split dual-density forefoot varus compensation.

The 45 degree split dual-density methods are generally preferred to the medial and lateral half dual-density methods because of a more even and gradual alteration of the weight-bearing gravitational forces as they are delivered and directed across the forefoot section of the footwear during the midstance and propulsive phases of gait.

In effect, for most footwear, 35 durometer materials, plus or minus amounts up to 20 durometers of differences in materials, various combinations of different densities of materials, different materials, and/or varying thicknesses of materials, can be fashioned in such a manner as to provide an angular range and set parameters of not less than 2 degrees nor more than 14 degrees of forefoot varus or forefoot valgus compensation. Compensating and providing angular equivalents of 8 degrees plus or minus amounts up to 6 degrees would, under most circumstances, achieve the desired results at either the medial or lateral aspects of the footwear in either the case of a forefoot varus or a forefoot valgus compensation, respectively.

These parameters are necessary and advisable in order to be able to gradually introduce the novel and revolutionary concept of the present invention into use among the general population; since it is often necessary to gradually increase the amount of forefoot varus or valgus compensation in moderate increments, slowly, and over a gradual period of time in order to effectively achieve greater compliance and acceptance of the concept with fewer side effects, less discomfort, and shorter periods of adjustment.

It may also be necessary and advisable for certain individuals to be afforded the opportunity to obtain different, varying, and/or graded amounts of forefoot varus or valgus compensation in a manner similar to the present day shoe size and width selections or in the form of prescription footgear when their particular needs fall outside of the usual and customary 4 degrees to 8 degrees average range of inverted forefoot varus or everted forefoot valgus angulation. In this regard, it may also be necessary for shoe salespersons to be additionally trained in the proper evaluation of the various foot types so that they might become more sophisticated in their ability to distinguish true forefoot varus and forefoot valgus foot types in order to select the appropriate forefoot compensation for the individual's particular foot type and planal predominance.

According to the present invention new footwear is provided accommodating the foot's natural angulation by providing a sole of dual-density materials which compensates the human foot to its environment. It has been found that the dual-density sole of the footwear of the present invention aligns the foot by compensating to angulate the forefoot to the heel and as a result, the entire foot to the ground for proper weight-bearing and even weight distribution. That is, the dual-density sole of the present invention compensates the forefoot and by so doing, whether the foot is standing still or in normal walking or running gait, weight-bearing forces directed through the foot pass closer to the median sagittal plane and the normal longitudinal axis of motion of the foot from rearfoot to forefoot. The footwear of the present invention compensates the varus or valgus forefoot to modern civilization's usually flat surfaces.

The advantages of the footwear of the present invention are that whether for normal standing, walking or for running, the footwear is adapted to the flat surface while the foot is maintained in its natural position. In standing, walking or running, excessive pronation and supination is reduced, controlled or eliminated; the foot acts as a more immediate and effective fulcrum and lever for the walking or running step with a minimum waste of movement and distortion of the natural foot. Impact shock to the foot and the entire skeletal complex is minimized as the foot functions more efficiently and as a more effective shock absorber. The forward movement of the foot from the strike of the heel in its normal gait in walking or running proceeds to a flat contact of the footwear of the present invention with a flat surface during its fully weight-bearing midstance phase of gait; while the foot itself, having a minimum of pronation or supination, functions at its optimum since the footwear itself has been adapted to the flat surface. Thus whether in standing, walking or running as the footwear makes contact with the ground starting at at the heel, the footwear moves forward with generally flat, smooth, and congruous impact with a flat surface.

The footwear of the present invention has a more even and harmonious contact with a flat surface and the push-off phase of the gait is more firmly focused on the first metatarsal-phalangeal joint (big toe joint) for better propulsion. The weight-bearing gravitational forces are more evenly directed through the foot for most optimal, efficient, and effective standing, walking, or running; and thereby, reduce, eliminate, or prevent much of the foot, leg, or back symptomotology commonly seen in clinical medical practice. Increased efficiency of walking or running also produces faster walking or running elapsed times so important to the competitive athlete.

BRIEF DESCRIPTION OF THE DRAWINGS

Although such novel feature or features believed to be characteristic of the invention are pointed out in the claims, the invention and the manner in which it may be carried out may be further understood by reference to the description following and the accompanying drawings.

Referring now to the figures in greater detail where an example of a right foot is depicted and where like reference numbers denote like parts in the various figures; the same would also apply to a left foot in a similar but reversed manner.

As shown in FIG. 1, the most common and prevailing human foot type, forefoot varus, has the forefoot (metatarsus) section of the foot, depicted by line F, and the metatarsal bones 1 through 5 inverted in their natural off weight-bearing position relative to the rearfoot (tarsus) section of the foot and the heel (calcaneus) bone 7 and to the horizontal plane of a flat surface D.

Figure 1:
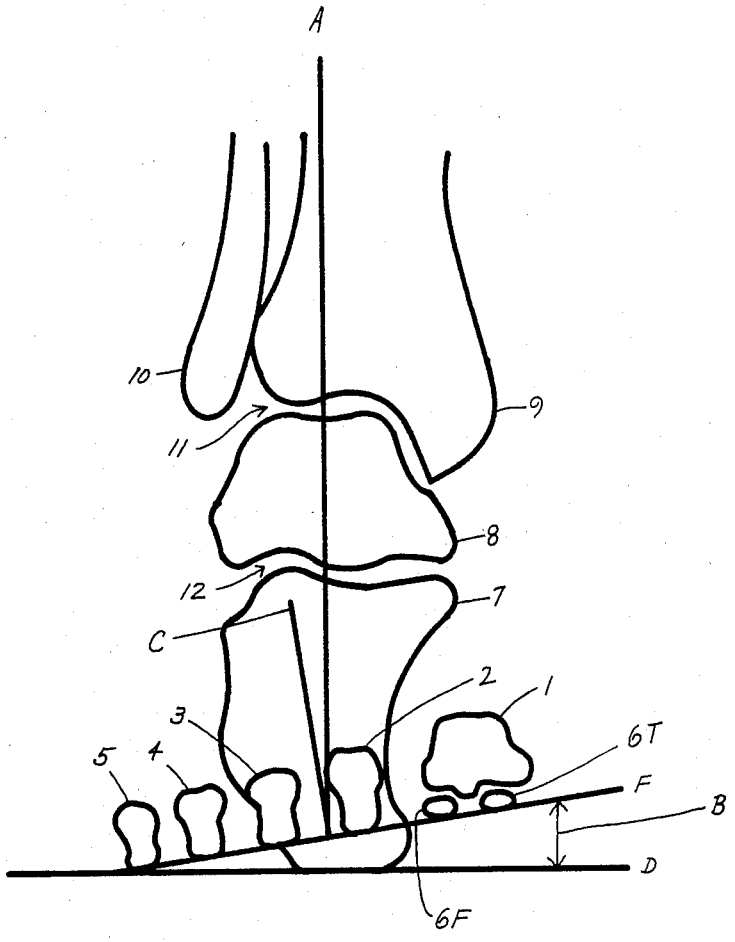
FIG. 1 is a plan view of a skeletal right foot, ankle, and lower leg as viewed from anterior to posterior (from the front to the back) and illustrates the most common, forefoot varus foot type, anatomically.
Figure 2:
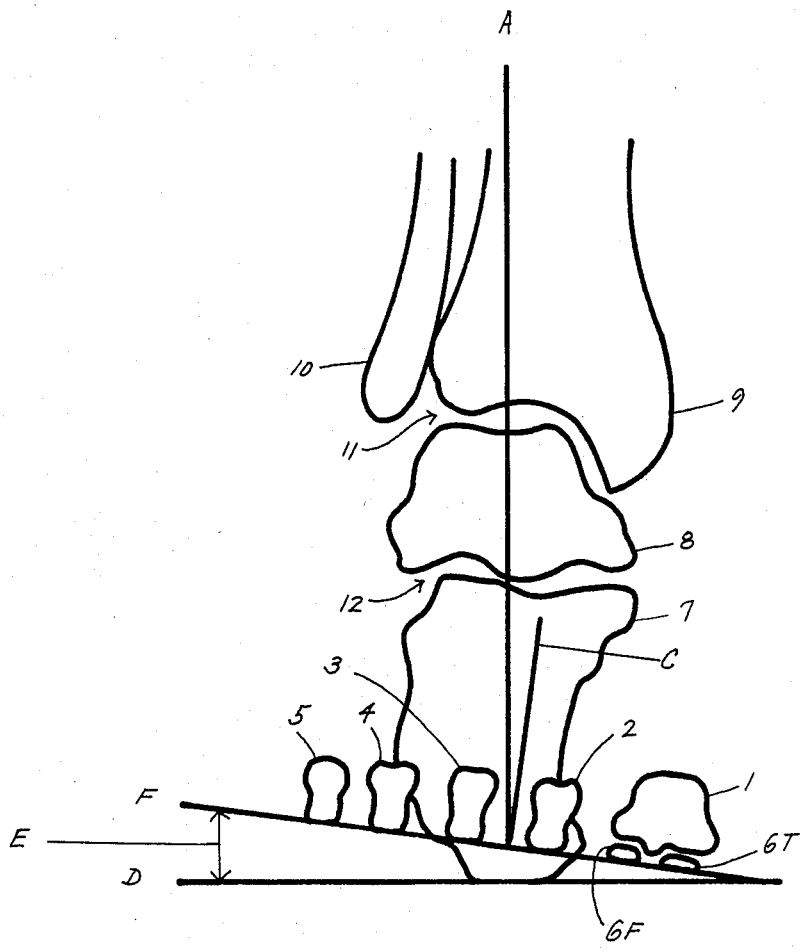
FIG. 2 is a plan view of a skeletal right foot, ankle, and lower leg as viewed from anterior to posterior (from the front to the back) and illustrates the less common and occasional, forefoot valgus foot type, anatomically.
Figure 3:
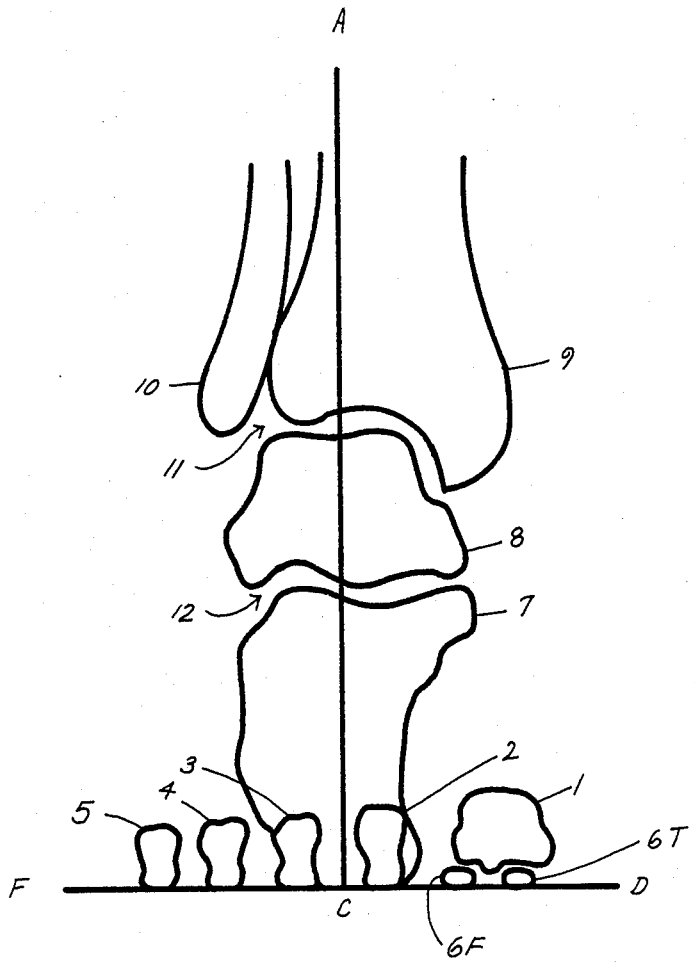
FIG. 3 is a plan view of a skeletal right foot, ankle, and lower leg as viewed from anterior to posterior (from the front to the back) and illustrates the very rare and "ideal" anatomical foot type which would be perfectly aligned in each and all of its aspects for placement and function on a flat surface.

The heads of the metatarsal bones 1 through 5 at the ball of the foot as shown in FIGS. 1, 2, and 3 correspond to the first (big toe) joint 1 and the big toe, the second 2, third 3, and fourth 4 lesser toe joints and toes of the foot and the fifth (little toe) joint 5 and the little toe, respectively. The first metatarsal bone 1 and the big toe are considerably larger than any of the lesser metatarsal bones 2, 3, 4, and 5 and the lesser toes. The tibial and fibular sesamoid bones, 6T and 6F, respectively, are located beneath the head of the first metatarsal bone 1 and act as shock absorbers for the big toe joint. They also act as a fulcrum for certain muscles that govern and control function of the big toe.

The talus (astragalus) bone 8 lies atop the heel bone 7 and, along with the distal ends of the long bones of the lower leg, the tibia bone 9 and the fibula bone 10 comprise the ankle joint 11 and the subtalar joint 12. The large bony prominence of the tibia bone 9 on its medial aspect is the inside bone of the ankle while the lower end of the fibula bone 10 is the outside bone of the ankle.

Line A in FIGS. 1, 2, and 3 represents the bisection of the lower leg, the ankle, the subtalar joint, and the heel bone at heel strike and at the initial contact stage of the midstance phase of gait. At this instance, shortly after impact with the ground supporting surface, the heel (rearfoot) has already moved its anticipated and normal amount from its naturally inverted, off weight-bearing, position and has already allowed a normal amount of pronation of the rearfoot to occur. The forefoot F at this moment, is still in its natural position slightly inverted, as noted by line B, to the flat surface D; since at this instance, the forefoot F is still not yet fully loaded nor fully weight-bearing.

The angle created between lines D and F is usually in a range of from 8 degrees plus or minus amounts up to 6 degrees. This discrepancy between these two lines accounts for the variety of forefoot varus foot types so commonly and frequently observed in the greatest percentage of the general population.

Line C in FIGS. 1, 2, and 3 represents the median sagittal plane (the midline) and bisection of the forefoot. This line is perpendicular to the plantar surface of the forefoot F and is drawn primarily for reference purposes.

Figure 8:
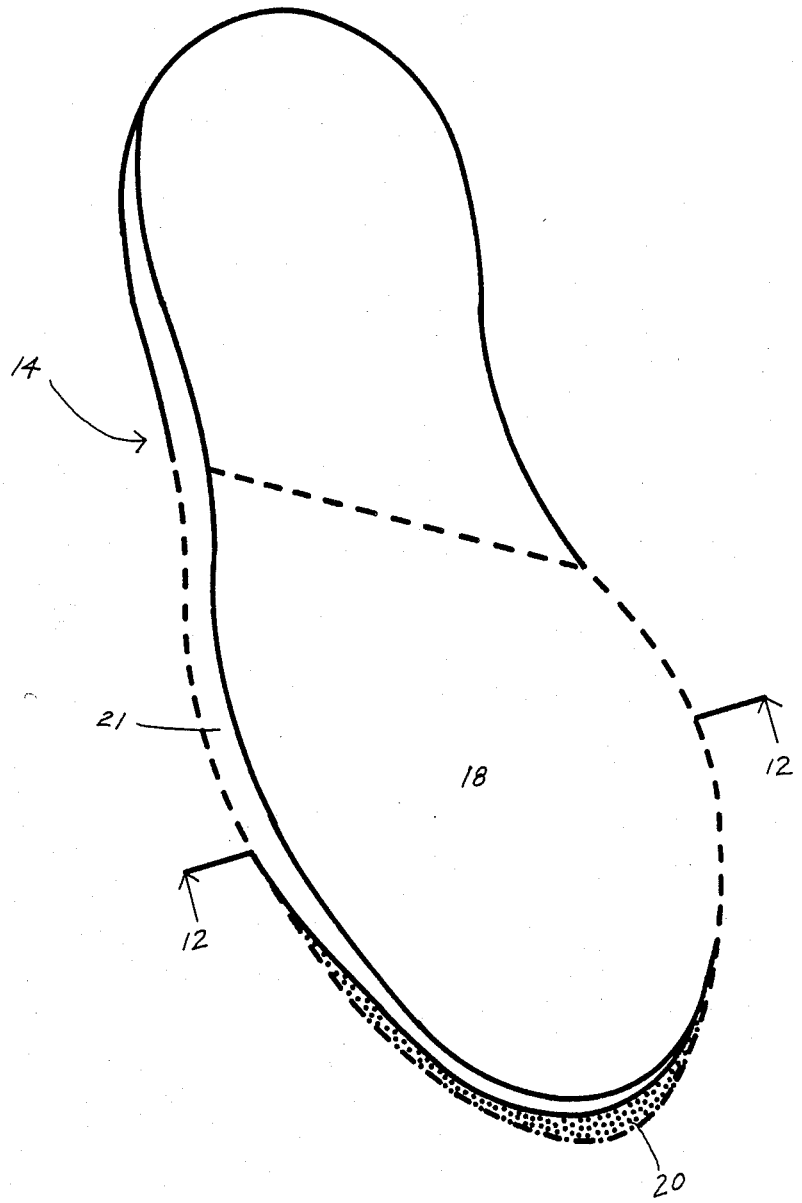
FIG. 8 is a perspective plan view of a right midsole of the footwear of the present invention, (in this example, a running shoe midsole), showing the area of a 45 degree split dual-density forefoot varus compensation in phantom and defined by the outlined broken lines and whereby the dotted shaded area represents a denser material than that of the non-shaded area which represents a less dense material.
Figure 10:
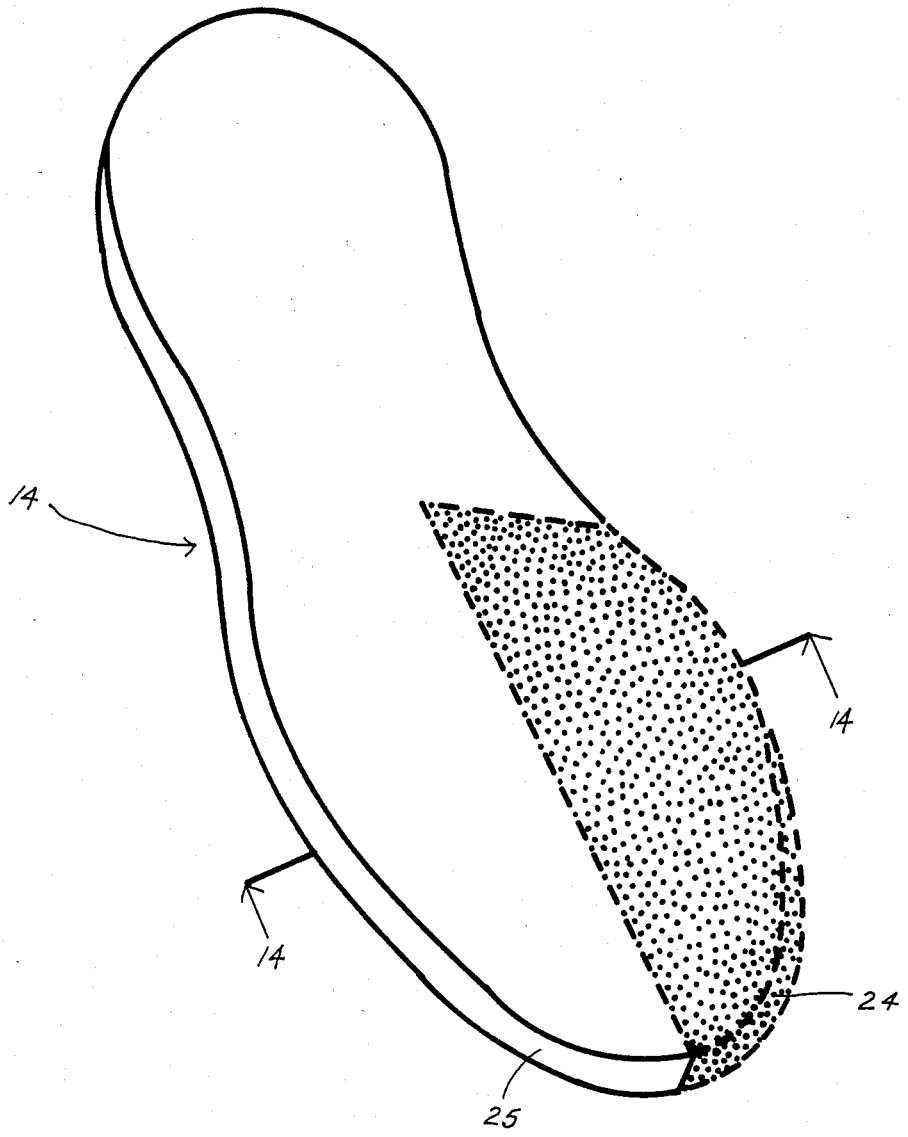
FIG. 10 is a perspective plan view of a right midsole of the footwear of the present invention, (in this example, a running shoe midsole), showing the area of a medial and lateral half dual-density forefoot varus compensation in phantom and defined by the outlined broken lines and whereby the dotted shaded area represents a denser material than that of the non-shaded area which represents a less dense material.

The forefoot varus compensations of the present invention shown in FIGS. 8 and 10 effectively occupy the angular space between lines F and D in FIG. 1 when applied to an article of footwear of an individual who has a foot type that is characterized by an inherent forefoot varus component; thereby effectively accomodating the space created between lines F and D as noted by the distance, line B in FIG. 1. By so doing, excessive amounts of over-pronation, arising from the foot's need to compensate for an inherent forefoot varus foot type, are either reduced or eliminated and the foot is able to function more optimally in its natural position without having to compensate by rolling inward and down toward society's usually flat surface.

Without the forefoot varus compensations of the present invention, the plantar surface of the forefoot F in FIG. 1 would be required to go through an excessive range and amount of motion in the direction of evertion to close the distance noted by line B and to occupy the area between lines F and D in FIG. 1, in order to come into complete contact with the flat surface D when weight-bearing forces are fully loaded on the entire foot (both rearfoot and forefoot) during the full weight-bearing stages of the midstance and propulsive phases of gait. The closing of the distance B in FIG. 1 by the forefoot's F need to meet the ground supporting surface D causes excessive over-pronation and excessive eversion (rolling in) of the rearfoot as it follows the action and motion of the forefoot down to meet the ground. By examining FIG. 1, an observer gains a better appreciation of the discovery and fact that the structure and stability of the rearfoot are, indeed, highly dependent upon the structure and stability of the forefoot contrary to prior art thinking.

FIG. 2 shows the less frequent and occasional forefoot valgus foot type which is seen in less than 5% of the population. As noted in FIG. 2, the forefoot (metatarsus) section of the foot and the mctatarsal bones 1 through 5 are everted in their natural off weight-bearing position relative to the rearfoot (tarsus) section of the foot and the heel (calcaneus) bone 7, and to the horizontal plane of a flat surface D.

As drawn in FIG. 2, the position of the foot is also captured precisely at the moment shortly after heel strike and exactly at the moment of the midstance phase of gait when the forefoot makes its initial contact with the ground supporting structure of a flat surface D; however, still prior to the weight-bearing forces being shifted from the heel 7 to the forefoot section F of the foot.

The angle created by lines D and F are usually in a range of from 8 degrees plus or minus amounts up to 6 degrees and accounts for a number of variations of these limited forefoot valgus foot types that are occasionally seen in the population as a whole. The forefoot valgus compensations of the present invention shown in FIGS. 9 and 11 effectively occupy the angular space between lines F and D in FIG. 2 when applied to an article of footwear of an individual who has a foot type that is characterized by an inherent forefoot valgus component; thereby effectively accommodating the space created between lines F and D as noted by the distance, line E in FIG. 2. By so doing, excessive amounts of supination, arising from the foot's need to compensate for an inherent forefoot valgus foot type, are either reduced or eliminated and the foot is able to function more optimally in its natural position without having to compensate by twisting outward and away from society's usually flat surface.

Without the forefoot valgus compensations of the present invention, the plantar surface of the forefoot F in FIG. 2 would be required to go through an excessive range and amount of motion in the direction of inversion to close the distance noted by line E and to occupy the area between lines F and D in FIG. 2, in order to come into complete contact with the flat surface D when weight-bearing forces are fully loaded on the entire foot (both rearfoot and forefoot) during the full weight-bearing stages of the midstance and propulsive phases of gait. The closing of the distance E in FIG. 2 by the forefoot's F need to meet the ground supporting surface D causes excessive supination and excessive inversion (outward rolling) of the rearfoot as it follows the action and motion of the forefoot down to meet the ground. By examining FIG. 2, once again, an observer gains a greater appreciation of the dependent relationship of the structure and stability of the rearfoot upon the structure and stability of the forefoot.

FIG. 3 is a schematic anatomical drawing of a perfectly square and level, "ideal foot type" according to the prior art biomechanics. As noted by the model diagram of FIG. 3, this "absolute foot type" would be ideally aligned in all of its individual components and ideally suited for optimum placement on a flat surface D whereby the plantar aspect of the forefoot F would also coincide with the horizontal plane of a flat surface D; and whereby "the bisection of the distal one-third of the lower leg is vertical, the ankle joint 11 and the subtalar joint 12 lie in transverse planes parallel to the supporting surface D, the bisection of the posterior surface of the (calcaneus) heel bone 7 is vertical, the plantar surface of the forefoot plane F parallels the plantar rearfoot plane and both parallel the supporting surface D″. In this "ideal" position, "the sagittal bisection of the posterior surface of the (calcaneus) heel bone 7 is perpendicular to the plantar plane of the foot, and the plantar surface of the heads of the five metatarsal bones F lie in a common plane parallel to the supporting surface D″. Additionally, and by pure chance, the rearfoot and heel bone 7 would also coincide exactly with the median sagittal plan (the midline) and bisection of the forefoot C in each and every respect, as noted in FIG. 3.

Such ideal relationships and "ideal human foot types" are seldom seen clinically, of course. It is theoretically possible, however, that they may be noted on extremely rare occasions. Nevertheless, the foot as shown in FIG. 3 has incredulously been used as the standard for normalcy in all of the prior art literature and texts in the science of biomechanics, the fields of medicine, and in the footwear design and construction industries. The "perfect" foot type as noted in FIG. 3 might well be suited for functioning in the conventional footwear of the prior art which has been traditionally constructed with generally flat soles for usually flat surfaces; however, as previously mentioned, this ideal foot type might occur in less than 1% of the world's population. This fact poignantly demonstrates how terribly inadequate flat-soled shoes of the prior art have served most people's feet in the past.

The examples used in FIGS. 8 to 15 are of a right midsole 14 unit component of a running shoe. When referred to as the midsole 14, the midsole is intended to be considered in its entirety.

Figure 9:
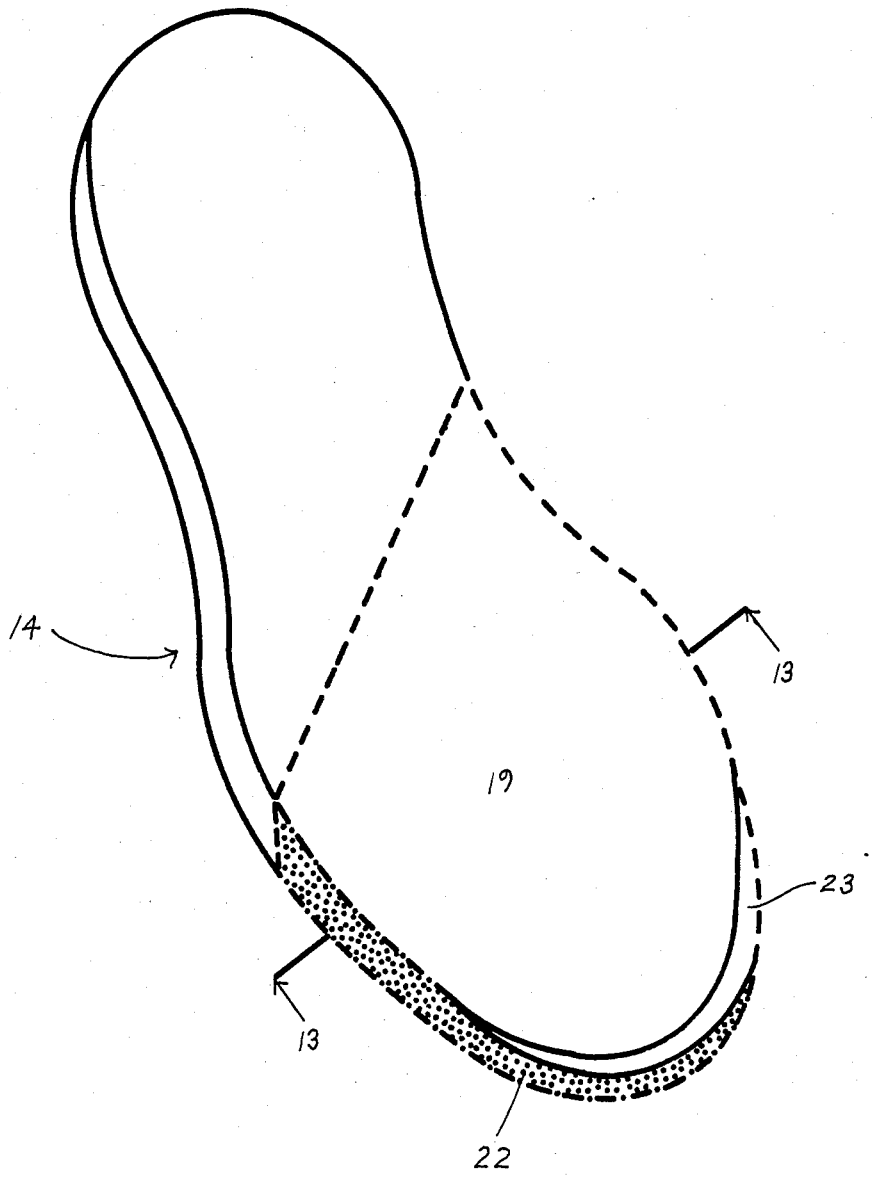
FIG. 9 is a perspective plan view of a right midsole of the footwear of the present invention, (in this example, a running shoe midsole), showing the area of a 45 degree split dual-density forefoot valgus compensation in phantom and defined by the outlined broken lines and whereby the dotted shaded area represents a denser material than that of the non-shaded area which represents a less dense material.
Figure 11:
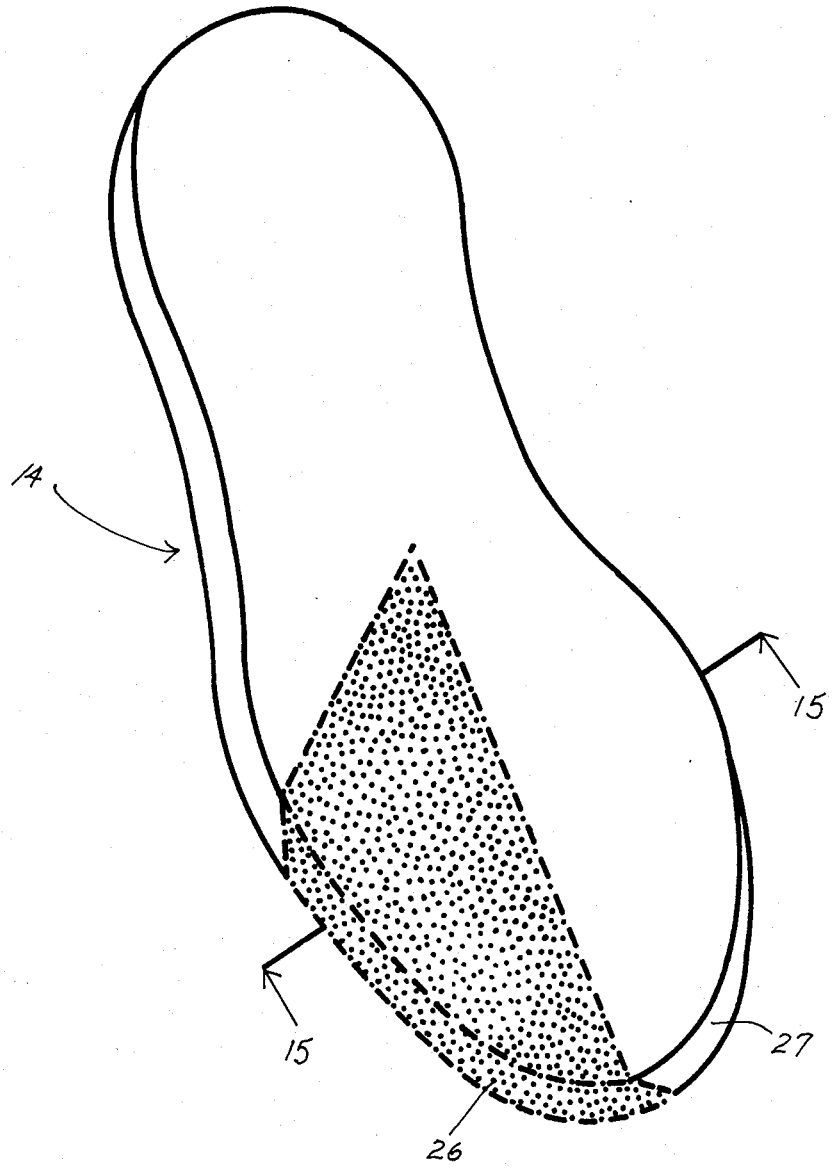
FIG. 11 is a perspective plan view of a right midsole of the footwear of the present invention, (in this example, a running shoe midsole), showing the area of a medial and lateral half dual-density forefoot valgus compensation in phantom and defined by the outlined broken lines and whereby the dotted shaded area represents a denser material than that of the non-shaded area which represents a less dense material.

The area of the forefoot compensations in FIGS. 8 and 9 are labeled 18 and 19, respectively. These correspond to a 45 degree split dual-density forefoot varus compensation 18 and a 45 degree split dual-density forefoot valgus compensation 19. A medial and lateral half dual-density forefoot varus compensation is depicted by FIG. 10 and a medial and lateral half dual-density forefoot valgus compensation is depicted by FIG. 11.

The midsoles 14 as shown in FIGS. 12–15 are labeled 14M and 14L to correspond with the medial aspects and the lateral aspects of the midsoles, respectively. FIGS. 12–15 also show the areas of the various forefoot compensations in cross-section, whereby the shaded areas 20, 22, 24, and 26 represent the utilization of a denser material of harder durometer units than that of the material used in the non-shaded areas 21, 23, 25, and 27 which represent a less dense material of softer durometer units.

Figure 4:
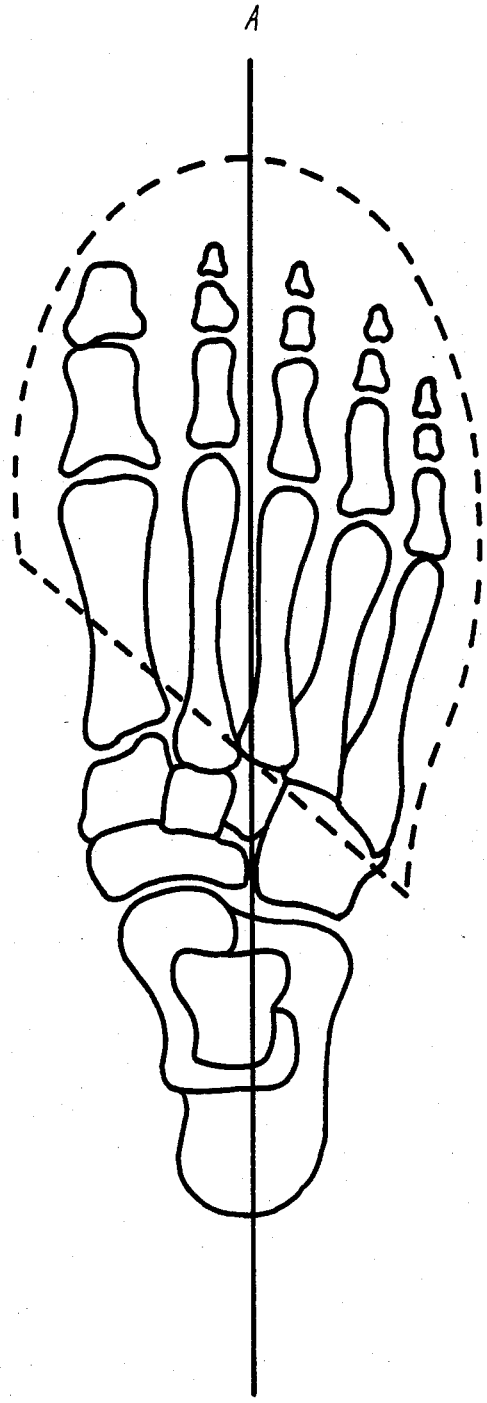
FIG. 4 is a plan view of a skeletal right foot as viewed from dorsal to plantar (from the top to the bottom) showing the area of a 45 degree split dual-density forefoot varus compensation of the footwear of the present invention as defined by the outlined broken line and superimposed upon the skeletal foot. Line A in FIG. 4 represents the median sagittal plane (the midline) and bisection of the foot for reference purposes.

The area of the sole of an article of footwear to be compensated by a forefoot varus compensation of the 45 degree split dual-density method is shown in FIGS. 4 and 8 and is defined by the broken line of the outlined area 18. FIG. 4 shows the area of the forefoot varus compensation, as viewed from top to bottom, in its relationship to the metatarsal bones, joints, and toes of a right foot and in its relationship to the median sagittal plane (the midline) and bisection of the foot, line A. The area of a 45 degree split dual-density forefoot varus compensation 18 in FIG. 8 is drawn in phantom and shows the shaded area 20 representin a denser material while the non-shaded area 21 represents a less dense material. In these examples of a running shoe midsole, usually ethyl vinyl acetate (EVA) or polyurethane are the materials commonly utilized in their construction.

Figure 12:
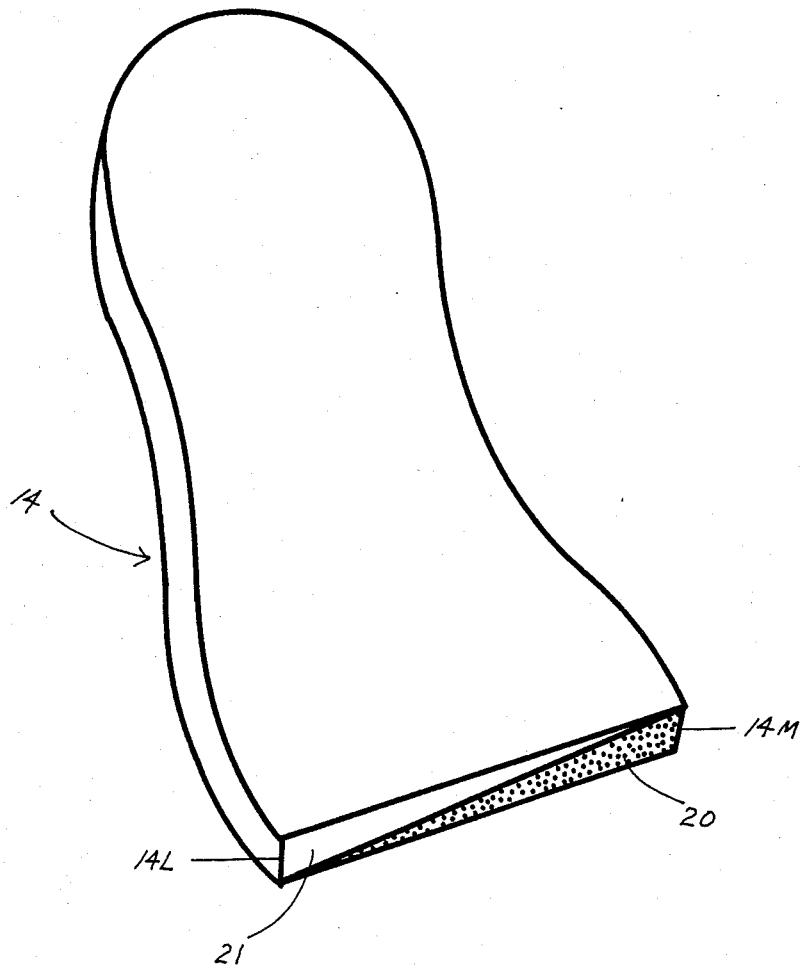
FIGS. 12 through FIGS. 15 are perspective plan views and cross-sections along lines 12—12 through lines 15—15 of FIGS. 8 through FIGS. 11, respectively.

The effective upward slope of the sole at the medial aspect of the footwear 14M in FIG. 12 is created by the use of different durometer materials that generally provide an effective angulation of 8 degrees plus or minus amounts up to 6 degrees beneath the ball and toes of the forefoot when compression forces have been exerted on the forefoot. The midsole 14 in FIG. 8 effectively slopes at a preferred angle throughout the area of the forefoot varus compensation 18 and along the metatarsal-phalangeal joints of a foot, lines 12—12 so that the sole of the footwear has the metatarsal bones, metatarsal-phalangeal joints, and toes of the forefoot held in their normal and natural inverted angle and position relative to a flat surface, substantially, as shown in FIG. 1.

By interfacing the midsole 14 as shown in FIG. 8 between the area of the plantar surface of the forefoot F and a flat surface D in FIG. 1, the position of the forefoot is effectively accommodated in its natural inverted position; thereby achieving the desired results. The natural position of the foot is left essentially unaltered within an article of footwear when the foot is full weight-bearing and when wearing footwear provided with a compensated sole of the present invention.

Figure 6:
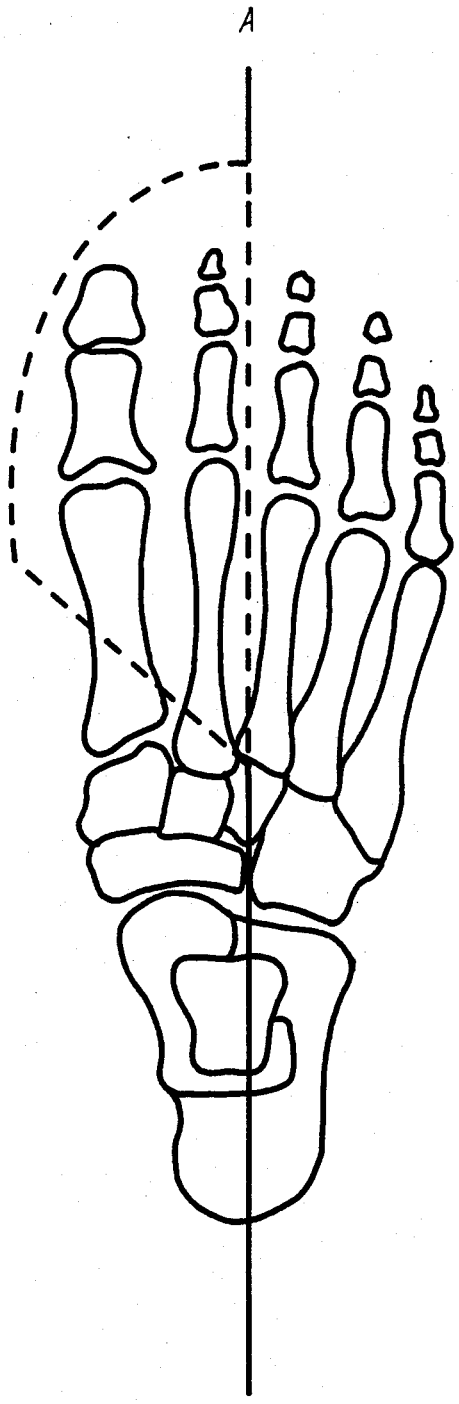
FIG. 6 is a plan view of a skeletal right foot as viewed from dorsal to plantar (from the top to the bottom) showing the area of a medial and lateral half dual-density forefoot varus compensation of the footwear of the present invention as defined by the outlined broken line and superimposed upon the skeletal foot. Line A in FIG. 6 represents the medial sagittal plane (the midline) and bisection of the foot for reference purposes.
Figure 14:
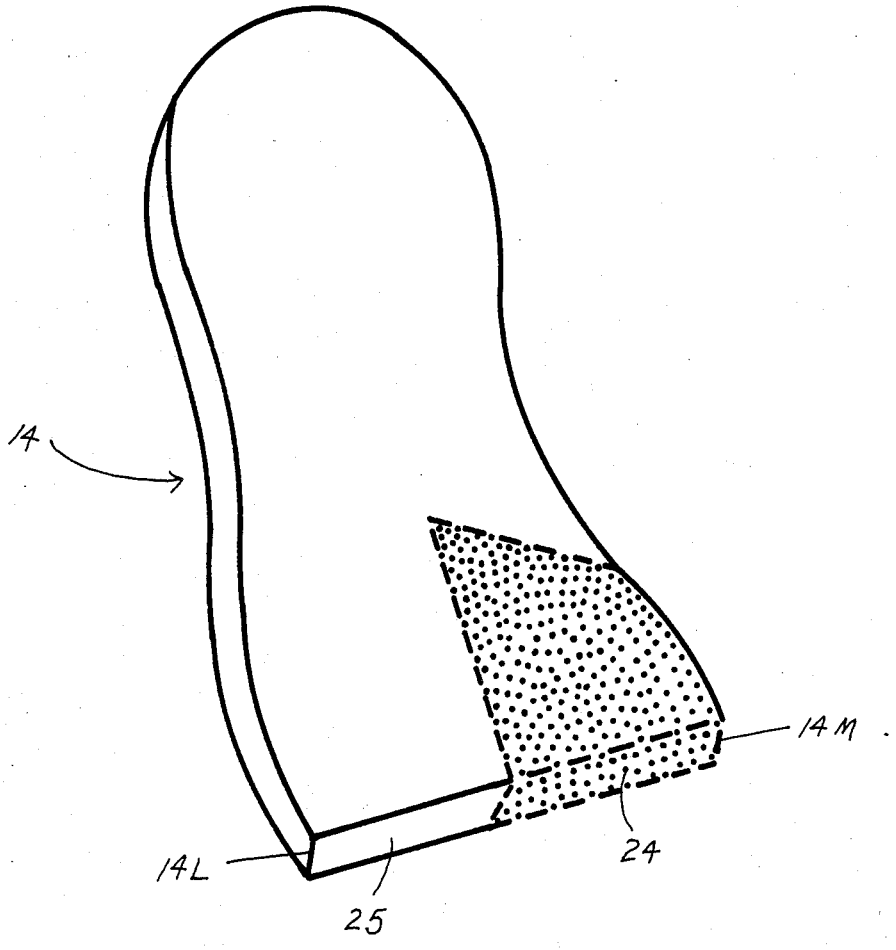

The area of the sole of an article of footwear to be compensated by a forefoot varus compensation of the medial and lateral half dual-density method is shown in FIGS. 10 and 14. FIG. 6 shows the area of this forefoot varus compensation, as viewed from top to bottom, in its relationship to the metatarsal bones, joints, and toes of a right foot and in its relationship to the median sagittal plane (the midline) and bisection of the foot, line A. The area of a medial and lateral half dual-density forefoot varus compensation in FIG. 10 is drawn in phantom and shows the shaded area 24 representing a denser material while the non-shaded area 25 represents a less dense material.

The effective upward slope of the sole at the medial aspect of the footwear 14M in FIG. 14 is created by the use of different durometer materials that generally provide an effective angulation of 8 degrees plus or minus amounts up to 6 degrees beneath the ball and toes of the forefoot when compression forces have been exerted on the forefoot. The midsole 14 in FIG. 10 effectively slopes at a preferred angle throughout the area of forefoot varus compensation and along the metatarsal-phalangeal joints of a foot, lines 14—14 so that the sole of the footwear has the metatarsal bones, metatarsal-phalangeal joints, and toes of the forefoot held in their normal and natural inverted angle and position relative to a flat surface, substantially, as shown in FIG. 1.

By interfacing the midsole 14 as shown in FIG. 10 between the area of the plantar surface of the forefoot F and a flat surface D in FIG. 1, the position of the forefoot is effectively accommodated in its natural inverted position; thereby achieving the desired results.

Figure 5:
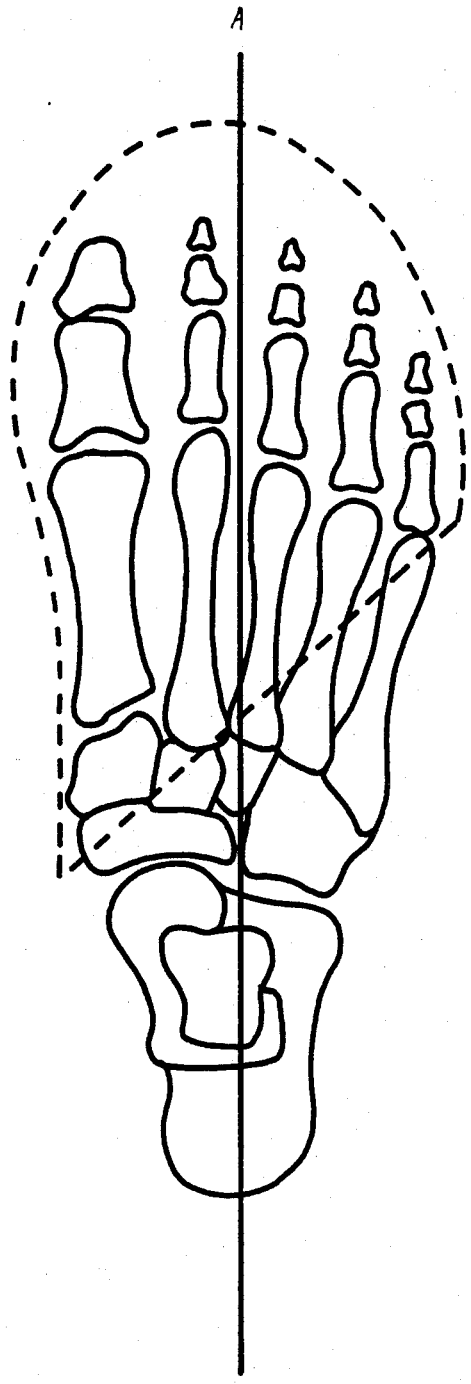
FIG. 5 is a plan view of a skeletal right foot as viewed from dorsal to plantar (from the top to the bottom) showing the area of a 45 degree split dual-density forefoot valgus compensation of the footwear of the present invention as defined by the outlined broken line and superimposed upon the skeletal foot. Line A in FIG. 5 represents the median sagittal plan (the midline) and bisection of the foot for reference purposes.

The area of the sole of an article of footwear to be compensated by a forefoot valgus compensation of the 45 degree split dual-density method is shown in FIGS. 5 and 9 and is defined by the broken lines of the outlined area 19. FIG. 5 shows the area of the forefoot valgus compensation, as viewed from top to bottom, in its relationship to the metatarsal bones, joints, and toes of a right foot and in its relationship to the median sagittal plane (the midline) and bisection of the foot, line A. The area of a 45 degree split dual-density forefoot valgus compensation 19 in FIG. 9 is drawn in phantom and shows the shaded area 22 representing a denser material while the non-shaded area 23 represents a less dense material.

Figure 13:
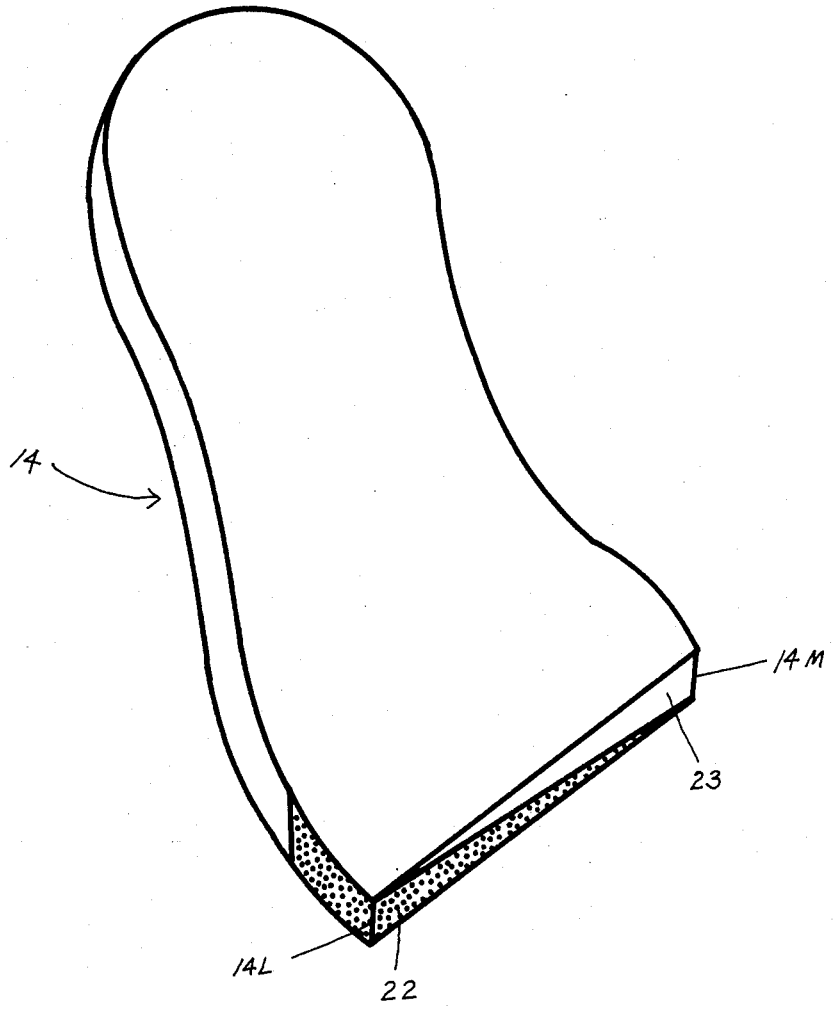

The effective upward slope of the sole at the lateral aspect of the footwear 14L in FIG. 13 is created by the use of different durometer materials that generally provide an effective angulation of 8 degrees plus or minus amounts up to 6 degrees beneath the ball and toes of the forefoot when compression forces have been exerted on the forefoot. The midsole 14 in FIG. 9 effectively slopes at a preferred angle throughout the area of the forefoot valgus compensation 19 and along the metatarsal-phalangeal joints of a foot, lines 13–13 so that the sole of the footwear has the metatarsal bones, mctatarsal-phalangeal joints, and toes of the forefoot held in their normal and natural everted angle and position relative to a flat surface, substantially, as shown in FIG. 2.

By interfacing the midsole 14 as shown in FIG. 9 between the area of the plantar surface of the forefoot F and a flat surface D in FIG. 2, the position of the forefoot is effectively accommodated in its natural everted position; thereby achieving the desired results.

Figure 7:
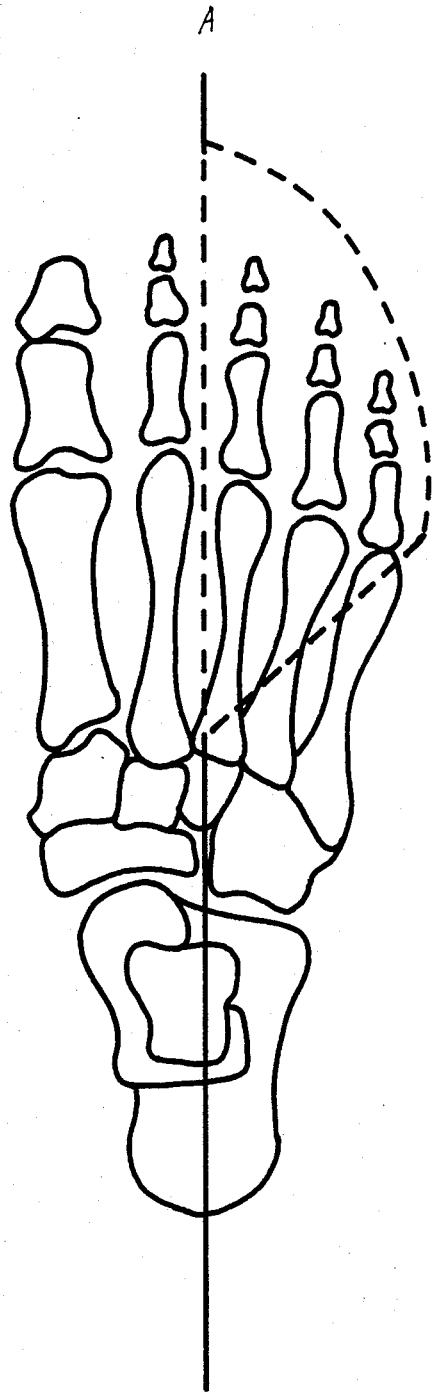
FIG. 7 is a plan view of a skeletal right foot as viewed from dorsal to plantar (from the top to the bottom) showing the area of a medial and lateral half dual-density forefoot valgus compensation of the footwear of the present invention as defined by the outlined broken line and superimposed upon the skeletal foot. Line A in FIG. 7 represents the median sagittal plan (the midline) and bisection of the foot for reference purposes.

The area of the sole of an article of footwear to be compensated by a forefoot valgus compensation of the medial and lateral half dual-density method is shown in FIGS. 7 and 11. FIG. 7 shows the area of this forefoot valgus compensation, as viewed from top to bottom, in its relationship to the metatarsal bones, joints, and toes of a right foot and in its relationship to the median sagittal plane (the midline) and bisection of the foot, line A. The area of a medial and lateral half dual-density forefoot valgus compensation in FIG. 11 is drawn in phantom and shows the shaded area 26 representing a denser material while the non-shaded area 27 represents a less dense material.

Figure 15:
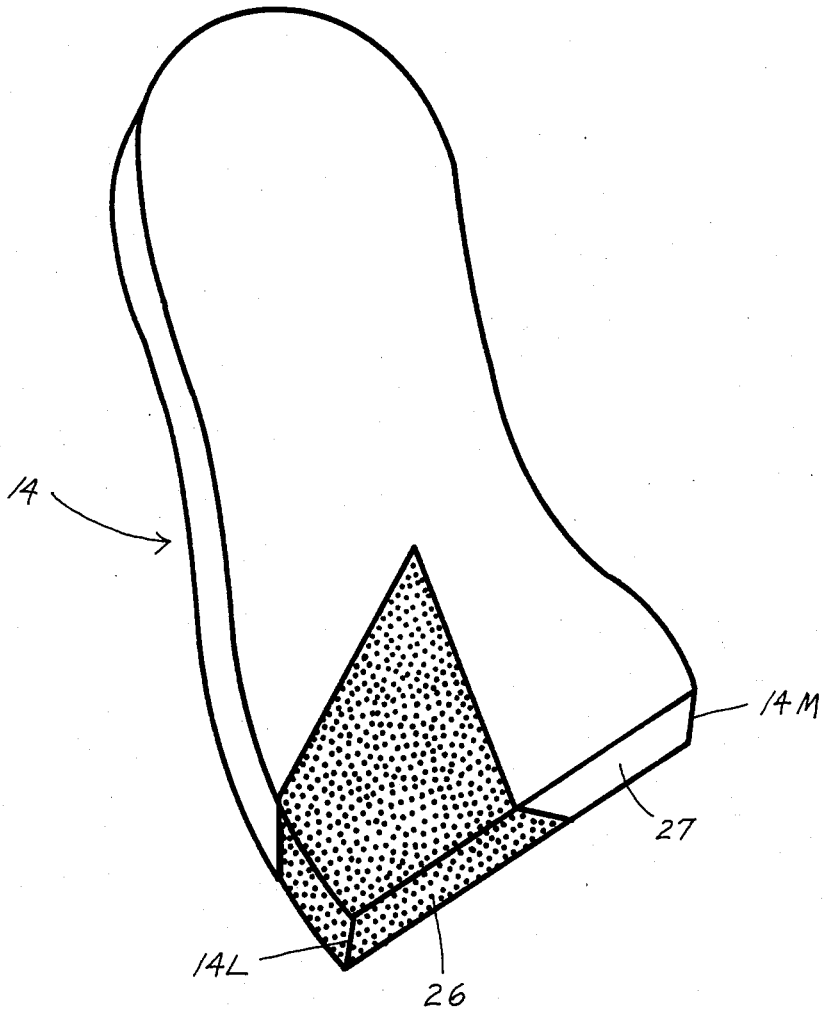

The effective upward slope of the sole at the lateral aspect of the footwear 14L in FIG. 15 is created by the use of different durometer materials that generally provide an effective angulation of 8 degrees plus or minus amounts up to 6 degrees beneath the ball and toes of the forefoot when compression forces have been exerted on the forefoot. The midsole 14 in FIG. 11 effectively slopes at a preferred angle throughout the area of forefoot valgus compensation and along the metatarsal-phalangeal joints of a foot, lines 15—15 so that the sole of the footwear has the metatarsal bones, metatarsal-phalangeal joints, and toes of the forefoot held in their normal and natural everted angle and position relative to a flat surface, substantially, as shown in FIG. 2.

By interfacing the midsole 14 as shown in FIG. 11 between the area of the plantar surface of the forefoot F and a flat surface D in FIG. 2, the position of the forefoot is effectively accommodated in its natural everted position; thereby achieving the desired results. Again, by each of the above four methods, the natural position of the foot is left essentially unaltered within an article of footwear when the foot is fully weight-bearing and when wearing footwear provided with compensated soles of the present invention.

In a running shoe midsole, as exemplified in these particular drawings, the compensations of the present invention are incorporated directly into the midsole 14 with the innersole and outersole being only secondarily effected by the compensations of the midsole itself. In other articles of footwear in which there is no midsole, the forefoot compensations of the present invention would be incorporated directly into either the innersole or the outersole of the footwear itself.

Innersoles, midsoles, and/or outersoles may each become an integral part of the present invention either independently or in combinations thereof; depending on the particular type of footwear and the particular fabrication process involved.

Outersoles may have gripping surfaces in which case the compensations of the present invention are employed to the top portion of the outersole closest to the conventional upper portion of an article of footwear; rather than interfering in any way with the outer bottom and gripping surfaces of the outersole itself.

The terms and expressions which are employed herein are used as terms of description only and it is recognized that various modifications are possible within the scope of the invention claimed.

It is understood the following claims are intended to cover all of the generic and specific features of the invention herein described, and all statements of the scope of the invention which, as a matter of language, might fall therebetween.

Without further elaboration the foregoing will so fully illustrate my invention that others may, by applying current or future knowledge, readily adapt the same for use under various conditions of service.

I claim:

1. In an article of footwear for use with a foot, said article having a sole, said sole having a forefoot and a rearfoot portion, said sole forefoot portion having a medial aspect and a lateral aspect, said sole forefoot portion being comprised of materials having differing compressibilities of materials selected and arranged across the width thereof such that said sole forefoot portion effectively slopes at an angle upwardly from said lateral aspect to said medial aspect when compression forces are exerted on the forefoot to provide an effective inclined surface of resultant thickness greater at said medical aspect of the forefoot than at said lateral aspect as a result of less compressible material being incorporated at said medial aspect of the forefoot than at said lateral aspect to compensate said forefoot in its naturally inverted angulation and to maintain the natural alignment, position, motion, and function of the entire foot during use of said article of footwear, and wherein said rearfoot portion is of constant thickness across the width thereof.

2. The sole of claim 1 wherein said sole is less compressible on the medial aspect of the forefoot and of greater compressibility at the lateral aspect of the forefoot for use by individuals who have a foot type that is characterized by an inherent forefoot varus component.

3. The sole of claim 1 wherein said sole effectively slopes upward from the lateral aspect of the forefoot to the medial aspect compensating the forefoot beneath the base and shafts of the metatarsal bones diagonally, the metatarsal-phalangeal joints (the ball of the foot), and the toes, giving the area beneath the first metatarsal-phalangeal joint (the big toe joint) the greatest support to compression forces and giving the area beneath the fifth metatarsal-phalangeal joint (the little toe joint) the least support to compression forces.

4. The sole of claim 1 wherein the overall dimensions of said sole are initially of the same thickness, off forefoot weight-bearing, and wherein the thickness of said sole is subsequently compressed more on the lateral aspect of the forefoot than on the medial aspect of the forefoot when compression forces are brought to bear on the forefoot, upon weight-bearing, giving the area beneath the first metatarsal-phalangeal joint (the big toe joint) the greatest effective subsequent thickness and elevation and giving the area beneath the fifth metatarsal-phalangeal joint (the little toe joint) the least effective subsequent thickness and elevation for individuals who have a foot type that is characterized by an inherent forefoot varus component.

5. The sole of claim 4 wherein the effective subsequent thickness of said sole forefoot portion is preferrably at a height of $\frac{1}{4}$ inch to $\frac{3}{8}$ inch greater at the medial aspect than at the lateral aspect.

6. The sole of claim 4 wherein the effective subsequent thickness of said sole forefoot portion is $\frac{3}{8}$ inch plus or minus amounts up to 5/16 inch greater at the medial aspect than at the lateral aspect.

7. The sole of claim 4 wherein the effective subsequent thickness of said sole forefoot portion is no less than 1/16 inch greater at the medial aspect than at the lateral aspect.

8. The sole of claim 4 wherein the effective subsequent thickness of said sole forefoot portion is no more than 11/16 inch greater at the medial aspect than at the lateral aspect.

9. The sole of claim 1 wherein the different compressible materials are arranged across the width of the forefoot at a 45 degree angle and laminated to one another and wherein said sole is less compressible on the medial aspect of the forefoot and of greater compressibility at the lateral aspect of the forefoot for use by individuals who have a foot type that is characterized by an inherent forefoot varus component.

10. The sole of claim 1 wherein said effective inclined surface has a preferred effective slope at an angle of 4 degrees to 8 degrees when compression forces are exerted on the forefoot.

11. The sole of claim 1 wherein said effective inclined surface has an effective slope at an angle of 8 degrees plus or minus amounts up to 6 degrees.

12. The sole of claim 1 wherein said effective inclined surface effectively slopes at an angle of no less than 2 degrees.

13. The sole of claim 1 wherein said effective inclined surface effectively slopes at an angle of no more than 14 degrees.

14. The sole of claim 1 wherein said sole's less compressible material on the medial aspect of the forefoot is preferrably of 45 durometer plus or minus 5 durometer hardness units and wherein said sole's material of greater compressibility at the lateral aspect of the forefoot is preferrably of 25 durometer plus or minus 5 durometer hardness units for use by individuals who have a foot type that is characterized by an inherent forefoot varus component.

15. The sole of claim 1 wherein said sole's differing compressibilities of materials are from a range of 15 durometer hardness units to 55 durometer hardness units.

16. The sole of claim 1 wherein said sole's forefoot portion differing compressibilities of materials and effective slope can be applied; to either the midsole, the outersole, or to the innersole component units of any article of footwear; to combinations of either the midsole and the outersole; the midsole and the innersole; the outersole and the innersole; or to all three of these component units in any article of footwear.

17. The sole of claim 1 wherein said sole's forefoot portion differing compressibilities of materials and effective slope can be combined with varying thicknesses of the same or different materials across the width thereof to enhance said sole's forefoot compensation and/or to provide for a wider range of selection and variation of said sole's forefoot compensation for use by individuals who have a foot type that is characterized by an inherent forefoot varus component.

* * * * *